US010117557B2

(12) United States Patent
Kim et al.

(10) Patent No.: US 10,117,557 B2
(45) Date of Patent: Nov. 6, 2018

(54) MOP MODULE AND ROBOT CLEANER HAVING THE SAME

(71) Applicant: LG ELECTRONICS INC., Seoul (KR)

(72) Inventors: Jihwan Kim, Seoul (KR); Hwang Kim, Seoul (KR); Sungil Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 604 days.

(21) Appl. No.: 14/956,205

(22) Filed: Dec. 1, 2015

(65) Prior Publication Data

US 2016/0150934 A1 Jun. 2, 2016

(30) Foreign Application Priority Data

Dec. 2, 2014 (KR) ..... 10-2014-0170736

(51) Int. Cl.
*A47L 11/20* (2006.01)
*A47L 11/40* (2006.01)
(Continued)

(52) U.S. Cl.
CPC ..... *A47L 11/20* (2013.01); *A47L 9/009* (2013.01); *A47L 9/0686* (2013.01);
(Continued)

(58) Field of Classification Search
CPC .... A44B 11/266; A47L 11/20; A47L 11/4011; A47L 11/4036; A47L 11/4094;
(Continued)

(56) References Cited

U.S. PATENT DOCUMENTS 3,599,265 A * 8/1971 D'Ercoli ..... B05C 17/00 15/144.1
6,581,239 B1 * 6/2003 Dyson ..... A47L 5/34 15/340.3

(Continued)

FOREIGN PATENT DOCUMENTS

JP H08-280592 10/1996
JP 2002-298929 10/2002

(Continued)

OTHER PUBLICATIONS

Korean Office Action dated Oct. 30, 2015 issued in Application No. 10-2014-0169996.

(Continued)

*Primary Examiner* — Joseph J Hail
*Assistant Examiner* — Arman Milanian
(74) *Attorney, Agent, or Firm* — Ked & Associates, LLP

(57) ABSTRACT

A mop module for a robot cleaner may include a module body detachably coupled to a cleaner body; and a mop mounted to the module body, and configured to wipe a floor as the cleaner body moves. The module body may include a hook protruding from the module body, and detachably mounted to the cleaner body by being elastically deflected; and a pressing member installed at the module body so as to be moveable in opposing directions, and configured to elastically deflect the hook.

15 Claims, 14 Drawing Sheets

(51) Int. Cl.
*A47L 9/00* (2006.01)
*A47L 9/06* (2006.01)

(52) U.S. Cl.
CPC ..... *A47L 11/4011* (2013.01); *A47L 11/4036* (2013.01); *A47L 2201/00* (2013.01); *A47L 2201/04* (2013.01)

(58) Field of Classification Search
CPC .. A47L 13/44; A47L 2201/00; A47L 2201/04; A47L 9/009; A47L 9/0686; Y10T 24/45524; Y10T 24/45529
USPC ..... 296/1.08; 403/329
See application file for complete search history.

(56) References Cited

U.S. PATENT DOCUMENTS

| | | | | |
|---|---|---|---|---|
| 7,246,405 | B2 * | 7/2007 | Yan | A47L 5/28 15/340.1 |
| 8,210,766 | B2 * | 7/2012 | Schermer | D01H 4/32 19/112 |
| 8,220,104 | B1 | 7/2012 | Chu | |
| 8,898,844 | B1 * | 12/2014 | Dooley | A47L 11/10 15/319 |
| 2003/0235463 | A1 * | 12/2003 | Neumann | B25G 1/04 403/329 |
| 2005/0015913 | A1 * | 1/2005 | Kim | A47L 5/30 15/319 |
| 2008/0282490 | A1 * | 11/2008 | Oh | A47L 9/0472 15/246.3 |
| 2009/0229074 | A1 | 9/2009 | Oh | |
| 2010/0263161 | A1 | 10/2010 | Lee | |
| 2011/0162157 | A1 | 7/2011 | Dooley et al. | |
| 2011/0202175 | A1 | 8/2011 | Romanov et al. | |
| 2012/0167917 | A1 | 7/2012 | Gilbert, Jr. | |
| 2013/0232720 | A1 * | 9/2013 | Baek | A47L 9/009 15/340.1 |
| 2014/0130290 | A1 | 5/2014 | Jang et al. | |
| 2014/0182627 | A1 | 7/2014 | Williams et al. | |
| 2015/0230678 | A1 * | 8/2015 | Ko | A47L 9/106 15/347 |
| 2017/0280961 | A1 * | 10/2017 | Pellegrino | A46B 7/042 |
| 2018/0064305 | A1 * | 3/2018 | Lu | A47L 9/0673 |

FOREIGN PATENT DOCUMENTS

| | | | | | |
|---|---|---|---|---|---|
| JP | 2006-231028 | | | 9/2006 | |
| JP | 2007-520323 | | | 7/2007 | |
| KR | 10-2007-0064997 | A | | 6/2007 | |
| KR | 10-0809773 | B1 | | 3/2008 | |
| KR | 2008-0022342 | | | 3/2008 | |
| KR | 20080028219 | A | * | 3/2008 | A47L 11/28 |
| KR | 10-2010-0108839 | A | | 10/2010 | |
| KR | 10-0996531 | B1 | | 11/2010 | |
| KR | 20120088314 | A | * | 8/2012 | A47L 11/28 |
| KR | 20120129192 | A | * | 11/2012 | A47L 11/28 |
| KR | 10-10309796 | B1 | | 9/2013 | |
| KR | 20140096591 | A | * | 8/2014 | A47L 11/28 |
| TW | M430247 | U | * | 6/2012 | A47L 13/44 |
| WO | WO 2011/074716 | A1 | | 6/2011 | |
| WO | WO 2013/171462 | A2 | | 11/2013 | |

OTHER PUBLICATIONS

European Search Report dated Apr. 15, 2016 issued in Application No. 15195685.1.
Japanese Office Action dated Oct. 21, 2016 issued in Application No. 2015-235432.
United States Notice of Allowance dated Jan. 5, 2017 issued in U.S. Appl. No. 14/955,940.
U.S. Notice of Allowance dated Dec. 14, 2016 issued in co-pending U.S. Appl. No. 14/952,760.
European Search Report dated May 13, 2015 issued in Application No. 15195696.8.

* cited by examiner

MOP MODULE AND ROBOT CLEANER HAVING THE SAME

CROSS-REFERENCE TO RELATED APPLICATION

Pursuant to 35 U.S.C. § 119(a), this application claims the benefit of earlier filing date and right of priority to Korean Application No. 10-2014-0170736, filed on Dec. 2, 2014, the contents of which is incorporated by reference herein in its entirety.

BACKGROUND

1. Field

The present disclosure relates to a mop module configured to clean a floor as a cleaner body moves, and a robot cleaner having the same.

2. Background

Generally, a robot has been developed for an industrial use, and has managed some parts of factory automation. As the robot is applied to various fields recently, not only medical robots and space robots, but also home robots are being developed. A representative of the home robot is a robot cleaner, a kind of home electronic appliance capable of performing a cleaning operation by sucking dust on a floor (including foreign materials) while autonomously moving on a predetermined region. Such a robot cleaner is provided with a chargeable battery, and is provided with an obstacle sensor for avoiding an obstacle while moving.

The robot cleaner is configured to suck dust-contained air, to filter dust from the dust-contained air by a filter, and to discharge dust-filtered air to the outside. Recently, a robot cleaner, having a floor wiping function as well as its own function (a function to remove dust on a floor), is being developed to satisfy users' various demands. Hereinafter, the term "dust" is collectively used for at least one of dirt or dust.

For this, a robot cleaner, formed to attach a mop onto a bottom surface of a cleaner body, and configured to wipe (clean) a floor while moving, is being provided. However, such a robot cleaner may have the following problems. Firstly, since a mop installation structure is spatially restricted, a space to fill water is small. Further, wiping a floor may be inefficiently performed due to a small area of a mop.

BRIEF DESCRIPTION OF THE DRAWINGS

The embodiments will be described in detail with reference to the following drawings in which like reference numerals refer to like elements wherein.

DETAILED DESCRIPTION

Figure 1:
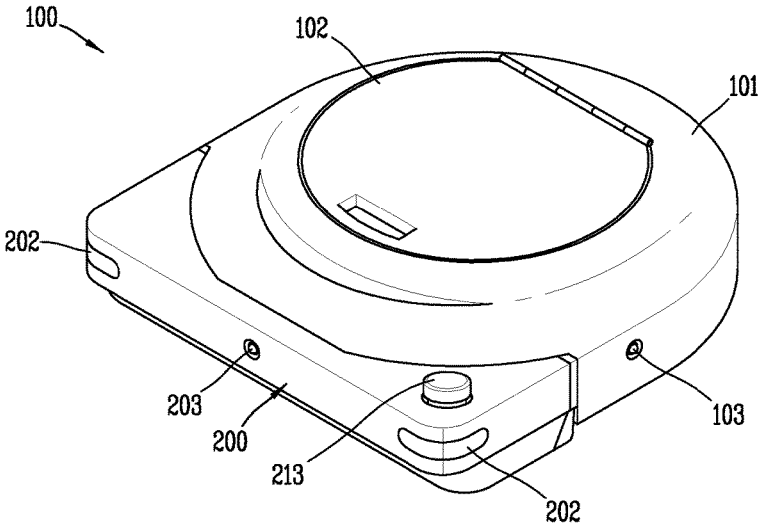
FIG. 1 is a perspective view of a robot cleaner according to the present disclosure.
Figure 2:
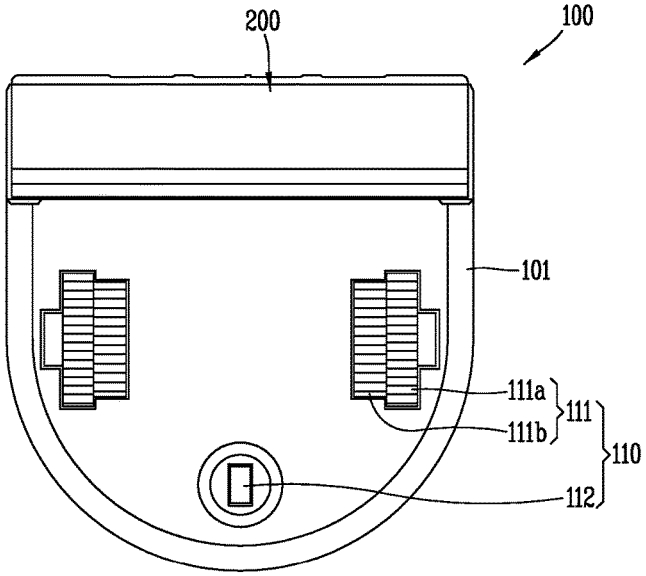
FIG. 2 is a bottom view of the robot cleaner of FIG. 1.
Figure 3:
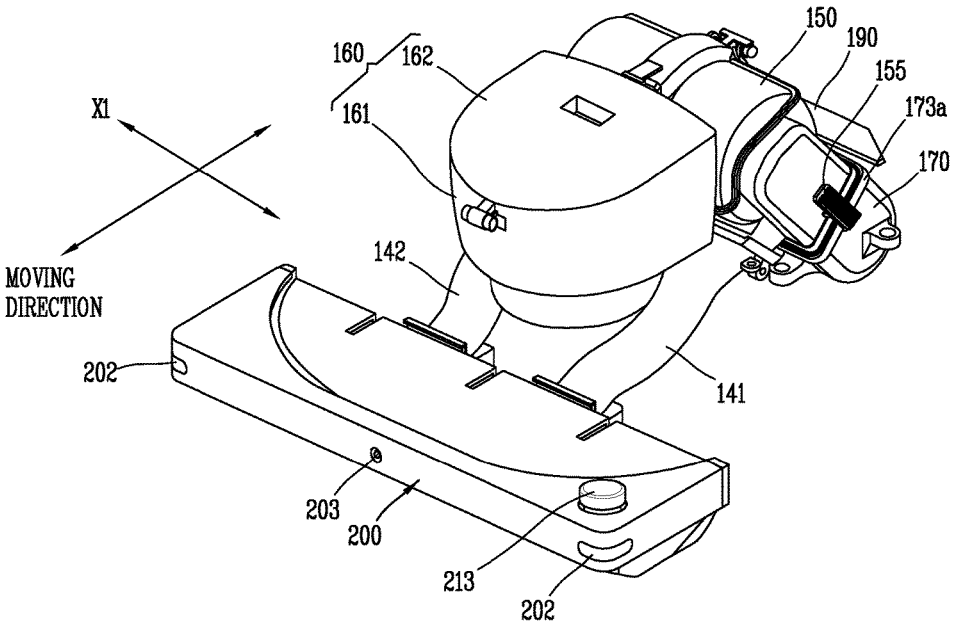
FIG. 3 illustrates main components inside the robot cleaner of FIG. 1.

Referring to FIGS. 1 to 3, the robot cleaner 100 performs a function to clean a floor while autonomously moving on a predetermined region. The robot cleaner 100 includes a cleaner body 101 for performing a moving function, a controller and a moving unit or module 110, e.g., motorized wheel. The cleaner body 101 is configured to accommodate components therein, and to move on a floor by the moving unit 110. The controller for controlling an operation of the robot cleaner 100, a battery for supplying power to the robot cleaner 100, etc. are mounted to the cleaner body 101.

The moving unit 110 is configured to move (or rotate) the cleaner body 101 back and forth or right and left, and is provided with main wheels 111 and a supplementary wheel 112. The main wheels 111 are provided at two sides of the cleaner body 101, and are configured to be rotatable in one direction or another direction according to a control signal of the controller. The main wheels 111 may be configured to be independently driven. For instance, each of the main wheels 111 may be driven by a different motor.

Each of the main wheels 111 may include wheels 111*a* and 111*b* having different radiuses with respect to a rotation shaft. Under such a configuration, in a case where the main wheel 111 moves up on an obstacle such as a bump, at least one of the wheels 111*a* and 111*b* contacts the obstacle. This can prevent idling of the main wheel 111. The supplementary wheel 112 is configured to support the cleaner body 101 together with the main wheels 111, and to supplement movement of the cleaner body by the main wheels 111.

The robot cleaner 100 of the present disclosure is configured to perform a floor wiping function using a mop, as well as a general cleaning function to suck dust (including foreign materials) on a floor. For this, a suction unit or module (see FIG. 8) 130 and a mop module 200 are selectively detachably-coupled to the cleaner body 101, according to a cleaning function to be executed. A user may mount the suction unit 130 to the cleaner body 101 when removing dust on a floor, and may mount the mop module 200 to the cleaner body 101 when wiping the floor. In this embodiment, for a floor wiping function by the robot cleaner 100, the mop module 200 is mounted to the cleaner body 101.

Figure 8:
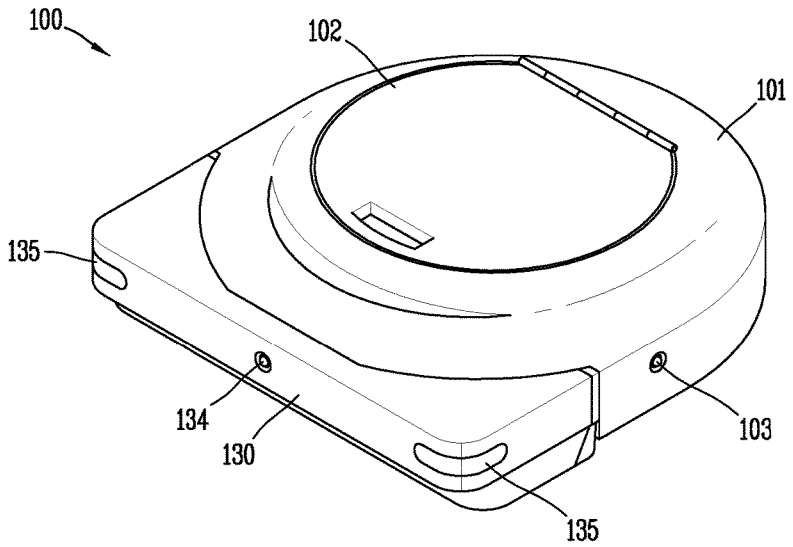
FIG. 8 is a perspective view illustrating a robot cleaner according to another embodiment of the present disclosure.
Figure 9:
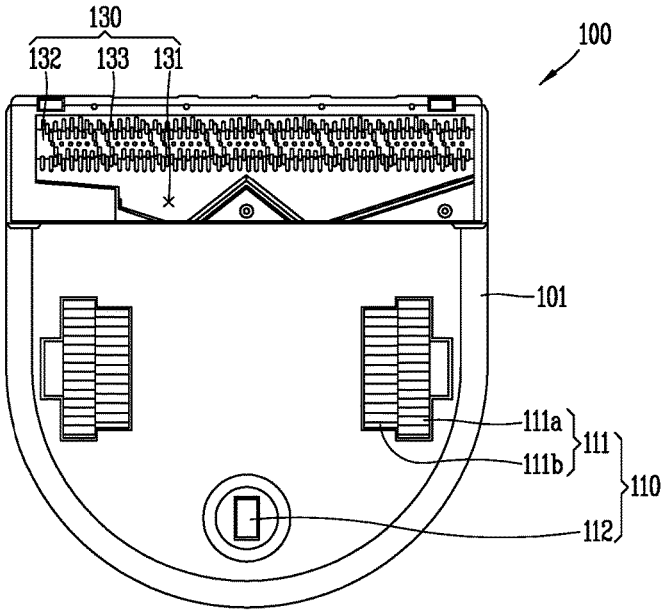
FIG. 9 is a bottom view of the robot cleaner of FIG. 8.
Figure 10:
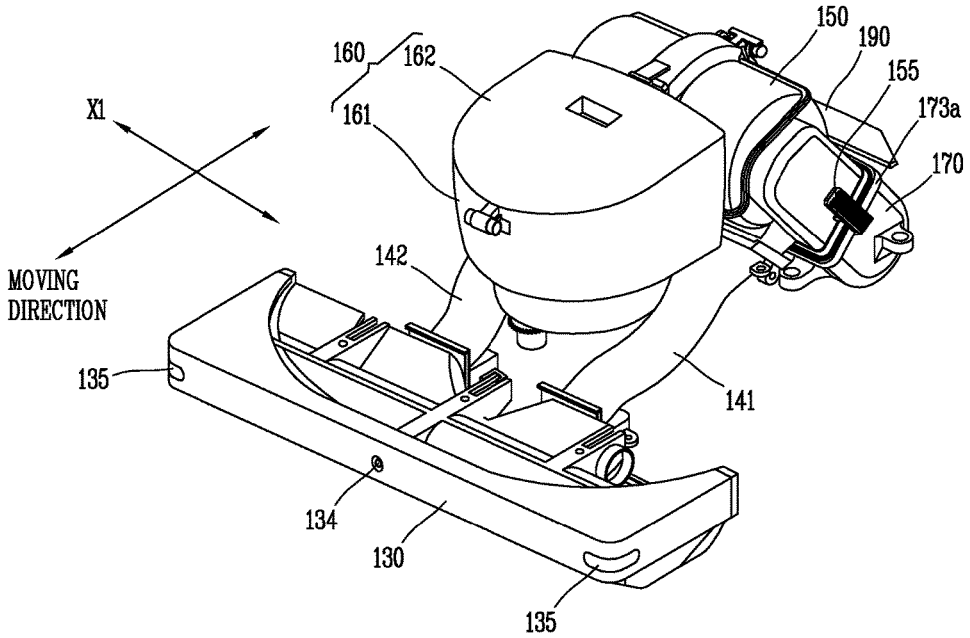
FIG. 10 illustrates inner components of the robot cleaner of FIG. 8.

As explained later in FIG. 8, the suction unit 130 is mounted to the cleaner body 101. The suction unit 130 is configured to suck dust-included air on a floor, and the sucked air is introduced into a cyclone unit 150 for separation of dust, through a guiding member. The guiding member has a cavity therein, since it serves as a passage along which air sucked through the suction unit 130 is transferred to the cyclone unit 150.

The mop module 200 may be detachably mounted to the guiding member when installed at the cleaner body 101 instead of the suction unit 130. The mop module 200 may be provided with a hook for coupling with the cleaner body 101. The hook may be detachably mounted to the guiding member or air flow guides. The guiding member may include first and second guiding members 141, 142 in correspondence to first and second cyclones 151, 152 of the cyclone unit 150. First and second hooks 211, 212 of the mop module 200 are mounted to the first and second guiding members 141, 142, respectively.

The mop module 200 is provided on a bottom surface of the cleaner body 101, and is configured to wipe a floor as the cleaner body 101 is moved by the moving unit 110. The mop module 200 may be provided in front of the cleaner body 101.

An obstacle sensor 203 is electrically connected to the controller and configured to sense an obstacle while the robot cleaner 100 moves. A damper 202 is formed of an elastic material to absorb a shock when the robot cleaner 100 collides with an obstacle, and may be provided at the mop module 200. An obstacle sensor 103 and a damper may be provided at the cleaner body 101.

Figure 4:
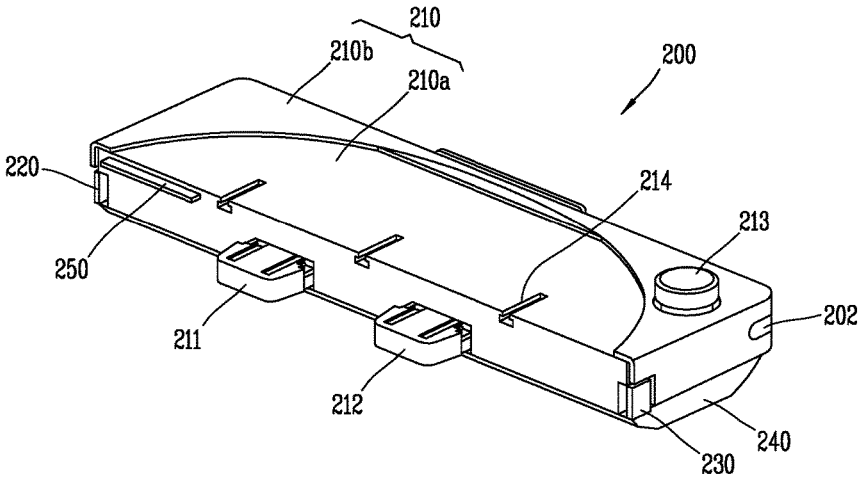
FIG. 4 is a perspective view of a mop module of FIG. 3.
Figure 5:
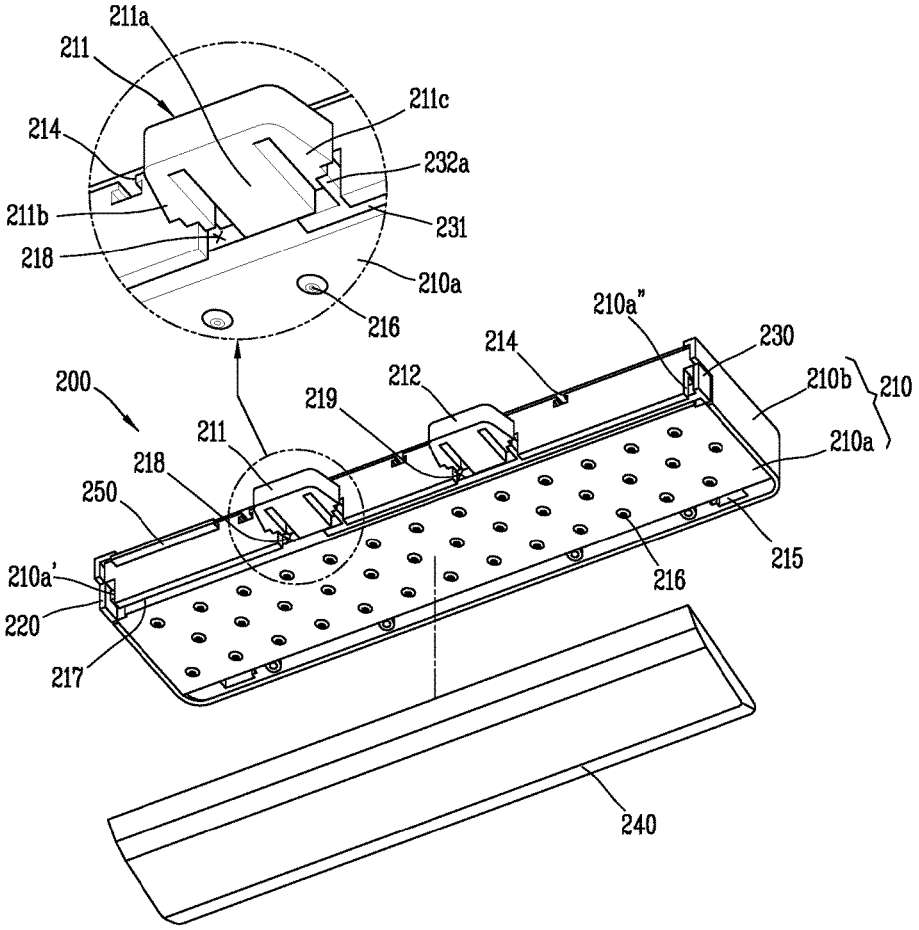
FIG. 5 is a disassembled perspective view of the mop module of FIG. 4.

Referring to FIG. 4, the mop module 200 includes a module body 210 and a mop 240. The mop module 200 may be formed to have the same or similar configuration as or to the suction unit 130 to be explained later. The module body 210 is detachably coupled to the cleaner body 101. An empty space for filling water may be formed in the module body 210. In the drawings, an opening communicated with the empty space is formed at an upper side of the module body 210. Water is injected into the module body 210 through the opening, and a cap 213 is configured to open and close the opening.

Grooves 214 may extend from the module body 210 along a mounting direction of the mop module 200 to the cleaner body 101, in order to guide insertion/separation of the mop module 200 into/from the cleaner body 101 when the mop module 200 is detachably mounted to the cleaner body 101. In this embodiment, the grooves 214 are formed in one direction at an upper surface of the module body 210. Ribs inserted into the grooves 214 may be formed at the cleaner body 101. The positions of the grooves and the ribs may be interchangeable with each other according to a modified design.

The module body 210 may be configured to be electrically connected to the controller when coupled to the cleaner body 101. A connector 250 to electrically connect to the controller of the cleaner body 101 when the module body 210 is mounted to the cleaner body 101 may be provided at the module body 210. The connector 250 is electrically connected to the aforementioned obstacle sensor 203, a heating unit to be explained later, etc., and controls driving of the electronic components of the mop module 200.

The module body 210 may include a body case 210*a* and a cover 210*b*. The aforementioned empty space for filling water may be formed in the body case 210*a*, and electronic components such as the obstacle sensor 203 and the connector 250 may be mounted to the body case 210*a*.

The cover 210*b* is detachably mounted to the body case 210*a*, and covers at least part of the body case 210*a*. The cover 210*b* may be formed of an elastic material, thereby protecting the body case 210*a*. As shown, dampers 202 for absorbing a shock may be provided on a plurality of positions. A hole may be formed at the cover 210*b* in correspondence to the obstacle sensor 203. Alternatively, the module body 210 may be composed of only the body case 210*a*, without the cover 210*b*.

The mop 240 is detachably coupled to the module body 210, and is configured to wipe a floor as the cleaner body 101 moves when mounted to the module body 210. The mop 240 may be formed of non-woven fabric, cloth and microfiber.

Referring to FIGS. 5-7B, a plurality of discharge holes 216, through which water contained in the module body 210 is discharged to the outside, are formed on a bottom surface of the module body 210. The plurality of discharge holes 216 are formed on a bottom surface of the body case 210*a* where the mop 240 is mounted.

As water is discharged out through the discharge holes 216, the mop 240 may serve as a wet mop. Discharge of water through the discharge holes 216 may be controlled by the controller, and the mop 240 may maintain a wet state as water is continuously supplied thereto under such a control. If water is not discharged out through the discharge holes 216, the mop 240 may serve as a dry mop.

A heating unit, configured to heat water contained in the module body 210 such that steam is discharged out through the discharge holes 216, may be provided in the module body 210. Driving of the heating unit may be controlled by the controller.

The mop 240 is detachably coupled to the module body 210. A Velcro structure or a hook structure for coupling with the mop 240 may be provided on a bottom surface of the module body 210. For example, a locking groove 215 is formed on a bottom surface of the module body 210, and a hook of the mop 240 is fixed to the locking groove 215.

The mop module 200 is detachably mounted to the cleaner body 101. The module body 210 may include a hook for coupling with the cleaner body 101, and a pressing member configured to press the hook by a user's pressing operation such that the module body 210 is easily separated from the cleaner body 101. The hook may protrude from the module body 210, and may be detachably mounted to the cleaner body 101 by force. The hook may include first and second hooks 211, 212 spaced from each other at the module body 210. Variations are possible. The hook may be provided in one in number, and may be mounted to another part of the cleaner body 101, rather than the guiding member.

The hook includes a hook body protruding from the module body 210, and an elastically portion connected to the hook body and elastically deformed or deflated by an external force. The first hook 211 includes a hook body 211*a*, and first and second elastic extensions 211*b*, 211*c* extending from two sides of the hook body 211*a* in the form of a cantilever. Like the first hook 211, the second hook 212 includes a hook body 212*a*, and first and second elastic extensions 212*b*, 212*c* extending from two sides of the hook body 212*a* in the form of a cantilever.

Figure 7A:
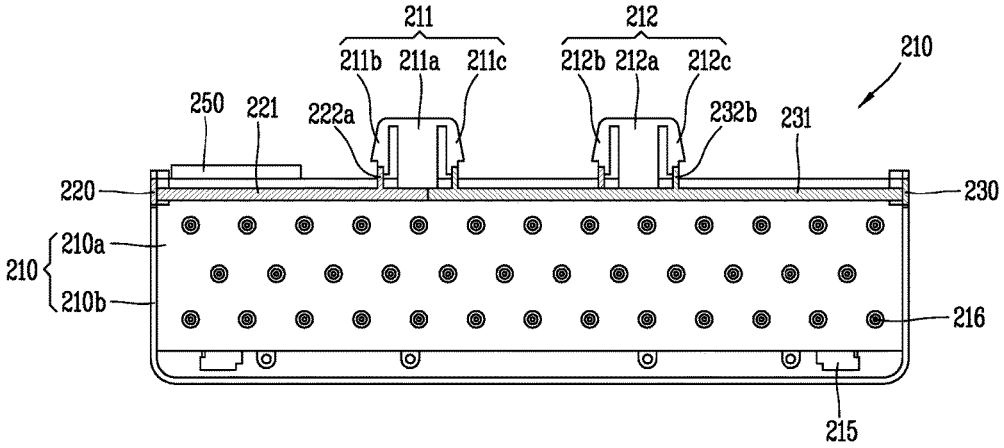
FIGS. 7A and 7B illustrate states before and after the first and second pressing members have been pressed in the module body of FIG. 5, respectively.
Figure 7B:
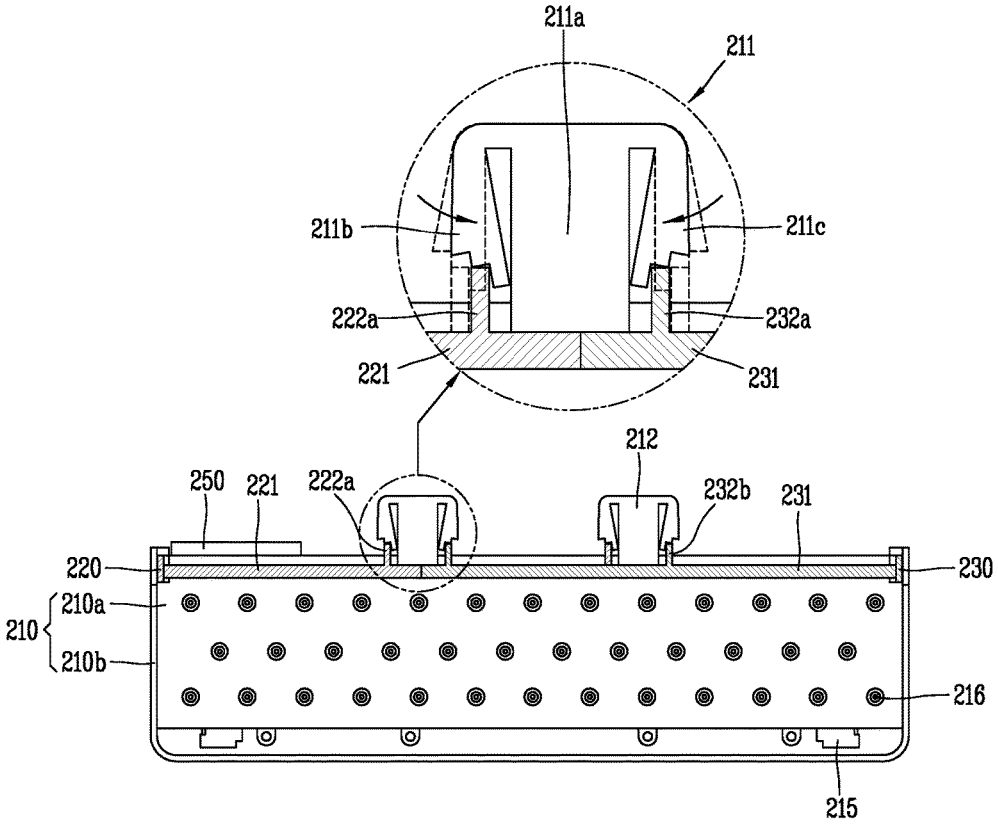

Referring to FIG. 7A, the first and second elastic extensions 211*b*, 211*c* of the first hook 211 extend to right and left sides of the hook body 211*a*, and the first and second elastic extensions 212*b*, 212*c* of the second hook 212 extend to right and left sides of the hook body 212*a*. With such a configuration, the second elastic extension 211*c* of the first hook 211, and the first elastic extension 212*b* of the second hook 212 face each other.

When the module body 210 is being mounted to the cleaner body 101, the elastic extensions elastically deflected toward the hook body 211*a* based on an external force. The module body 210 and the cleaner body 101 are coupled by the hooks based on the elastic extension being deflected. However, in the case where the module body 210 has been mounted to the cleaner body 101, it may be difficult to press the hooks in order to separate the module body 210 from the cleaner body 101, since the hooks are provided in the cleaner body 101.

To assist with the separation of the module body 210 from the cleaner body 101, the mop module 200 is provided with a pressing member (releasing slides) configured to press the hooks. The pressing member is installed at the module body 210 so as to be moveable in two opposite directions. When moved to one direction by a pressing operation, the pressing member presses the elastic extensions toward the hook body, thereby elastically deflecting or deforming the elastic extensions. The pressing member may be formed of a metallic or polymer material of high rigidity.

The pressing member may include a first pressing member (e.g., a first slide) or rod/shaft 220 configured to elastically deflector deform the first elastic extensions 211*b*, 212*b* in a pressing manner, and a second pressing member (e.g., a second slide) or rod/shaft 230 configured to elastically deflect or deform the second elastic extensions 211*c*, 212*c* in a pressing manner. The first and second pressing members 220, 230 may be provided at two sides of the module body 210, so as to be pressed toward each other. The first and second pressing members 220, 230 are configured to be moved in opposite directions when pressed, thereby pressing the first and second elastic extensions 211*b*, 211*c*, 212*b*, 212*c* toward the hook bodies 211*a*, 212*a*.

Figure 6:
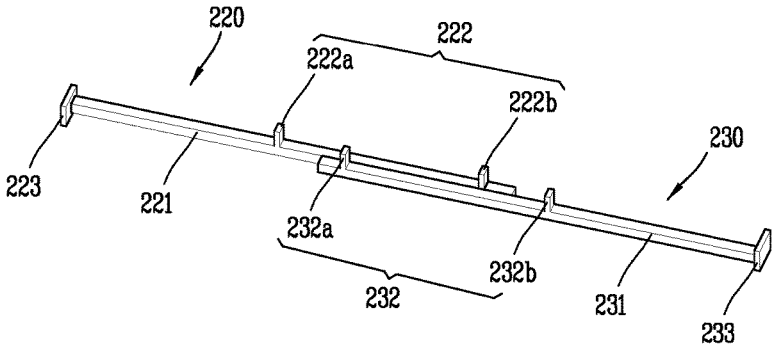
FIG. 6 that first and second pressing members have been separated from a module body of FIG. 5.

As shown in FIG. 6, the first and second pressing members 220, 230 include extension or slide rods or shafts 221, 231, pressing portions (e.g., protrusions) or tabs 222, 232, and manipulation portions or plates 223, 233, respectively.

The extension rods or shafts 221, 231 are formed to extend in one direction. The pressing portions 222, 232 protrude from the extension portions 221, 231, and are configured to press the elastic extensions when pressed. If the hook is composed of the first and second hooks 211, 212 in this embodiment, the pressing portions 222, 232 may be provided in plurality in correspondence to the number of the first and second hooks 211, 212, so as to elastically deflect the first and second hooks 211, 212 when the pressing members are pressed.

The first pressing member 220 includes a first pressing portion 222*a* and a second pressing portion 222*b* which are configured to press the first elastic extension 211*b* of the first hook 211 and the first elastic extension 212*b* of the second hook 212, respectively when pressed. Likewise, the second pressing member 230 includes a first pressing portion 232*a* and a second pressing portion 232*b* which are configured to press the second elastic extension 211*c* of the first hook 211 and the second elastic extension 212*c* of the second hook 212, respectively when pressed.

The manipulation portions 223, 233 are provided at one end of the extension rods or shafts 221, 231, and are exposed to the outside for a pressing operation. The manipulation portion 223 of the first pressing member 220 may be provided at one side of the module body 210 in an exposed state to the outside, and the manipulation portion 233 of the second pressing member 230 may be provided at another side of the module body 210 in an exposed state to the outside. Grooves 210*a*', 210*a*", which are inward recessed by a user's operation to press the manipulation portions 223, 233, may be formed at two sides of the module body 210.

The manipulation portions 223, 233 may be formed to contact the grooves 210*a*', 210*a*" by a user's operation to press the first and second pressing members 220, 230. The grooves 210*a*', 210*a*" may be configured to limit a movable range of the first and second pressing members 220, 230 when the first and second pressing members 220, 230 are pressed by a user.

The manipulation portions 223, 233 are formed not to protrude from a side surface of the module body such that the robot cleaner 100 which is running does not collide with an obstacle. The cover 210*b* may protrude more than the manipulation portions 223, 233, or may be on the same plane as the manipulation portions 223, 233.

The pressing members are installed at the module body 210 so as to be pressed. A guide groove 217, which extends along the one direction so as to guide movement of the extension rods/shafts 221, 231, may be formed at the module body 210. The guide groove 217 extends to two sides or opposite ends of the module body 210 so as to extend across the module body 210, and the first and second pressing members or release rods 220, 230 are installed at the guide groove 217.

The guide groove 217 may be deeply recessed toward the inside of the module body 210 in a lateral direction such that one pressing member covers or overlap at least part of another pressing member. The first pressing member 220 is firstly accommodated in the guide groove 217, and then the second pressing member 230 is accommodated in the guide groove 217. With such a configuration, the second pressing member 230 slides on the first pressing member 220 when pressed.

For prevention of separation of the first and second pressing members 220, 230 from the module body 210, a cover member may be mounted to the module body 210 so as to cover the guide groove 217. Alternatively, the guide groove 217 may be formed with a step toward the inside of the module body 210, for prevention of separation of the first and second pressing members 220, 230 from the module body 210.

Openings 218, 219, which are open toward one surface of the module body such that the pressing portions 222, 232 are exposed to the one surface of the module body where the hooks are formed, may be formed at the module body 210. In this embodiment, the openings 218, 219 are formed at positions corresponding to the first and second hooks 211, 212, respectively.

The first pressing portion 222*a* of the first pressing member 220 and the first pressing portion 232*a* of the second pressing member 230 are exposed to said one surface of the module body, through the opening 218 corresponding to the first hook 211, thereby facing the first and second elastic extensions 211*b*, 211*c* disposed at two sides of the first hook 211. Likewise, the second pressing portion 222*b* of the first pressing member 220 and the second pressing portion 232*b* of the second pressing member 230 are exposed to said one surface of the module body, through the opening 219 corresponding to the second hook 212, thereby facing the first and second elastic extensions 212*b*, 212*c* disposed at two sides of the second hook 212.

The first pressing member 220 is configured to press the facing first elastic extension 211*b* of the first hook 211 and the first elastic extension 212*b* of the second hook 212, when pressed. Likewise, the second pressing member 230 is configured to press the facing second elastic extension 211*c* of the first hook 211 and the second elastic extension 212*c* of the second hook 212, when pressed. When the first and second pressing members 220, 230 are pressed, the first and second hooks 211, 212 are elastically deflected or deformed so as to be separable from the cleaner body 101.

If the pressed state of the pressing operation is released, the pressing members are moved to another direction by a restoration force of the hooks. For instance, when the pressed state of the pressing operation is released, the first elastic extension 211*b* of the first hook 211 and the first elastic extension 212*b* of the second hook 212 are restored to original shape, thereby pressing the first pressing portion 222*a* and the second pressing portion 222*b* of the first pressing member 220. By the pressing operation, the first pressing member 220 is moved to another direction.

The first and second pressing portions 222*a*, 222*b* of the first pressing member 220 may be formed to be locked to one inner wall of the module body 210 which forms the openings 218, 219 corresponding thereto. Likewise, the first and second pressing portions 232*a*, 232*b* of the second pressing member 230 may be formed to be locked to one inner wall of the module body 210 which forms the openings 218, 219 corresponding thereto. With such a configuration, a moving range of the pressing members to another direction by restoration of the hooks may be restricted.

The first and second pressing portions 222*a*, 222*b* of the first pressing member 220 may be configured to contact the first elastic extension 211*b* of the first hook 211 and the first elastic extension 212*b* of the second hook 212, in a locked state to one inner wall of the module body 210 which forms the openings 218, 219 corresponding thereto. The first elastic extension 211*b* of the first hook 211 and the first elastic extension 212*b* of the second hook 212, may be provided with steps formed toward the inside thereof, so as to accommodate therein end parts of the first and second pressing portions 222*a*, 222*b* of the first pressing member 220, respectively.

The first and second pressing portions 233*a*, 233*b* of the second pressing member 230 may be configured to contact the second elastic extension 211*c* of the first hook 211 and the second elastic extension 212*c* of the second hook 212, in a locked state to one inner wall of the module body 210 which forms the openings 218, 219 corresponding thereto. The second elastic extension 211*c* of the first hook 211 and the second elastic extension 212*c* of the second hook 212, may be provided with steps formed toward the inside thereof, so as to accommodate therein end parts of the first and second pressing portions 232*a*, 232*b* of the second pressing member 230, respectively.

With such a structure, once the pressing members are pressed, the hooks may be elastically transformed. This may allow a user to separate the mop module 200 from the cleaner body 101 more easily.

The robot cleaner 100 of the present disclosure is configured to execute its own cleaning function to remove dust on a floor. For this, the mop module 200 may be separated from the cleaner body 101, and the suction unit 130 is mounted to the cleaner body 101. Referring to FIGS. 8-12, the robot cleaner 100 includes the suction unit 130, the first and second guiding members (first and second air flow guide tubes) 141, 142, the cyclone unit or module 150, and a fan unit or module 170.

The suction unit 130 is provided at a bottom portion of the cleaner body 101, and is configured to suck dust-contained air on a floor by the fan unit 170. The suction unit 130 may be arranged at a front side of the cleaner body 101, and may be detachably mounted to the cleaner body 101. The position of the suction unit 130 is related to a moving direction of the robot cleaner 100 when the robot cleaner 100 is normally operated.

An obstacle sensor 134 electrically connected to the controller and configured to sense an obstacle while the robot cleaner 100 moves, and a damper 135 formed of an elastic material and configured to absorb a shock when the robot cleaner 100 collides with an obstacle, may be provided at the suction unit 130. The obstacle sensor 134 and a damper may be provided at the cleaner body 101.

Figure 12:
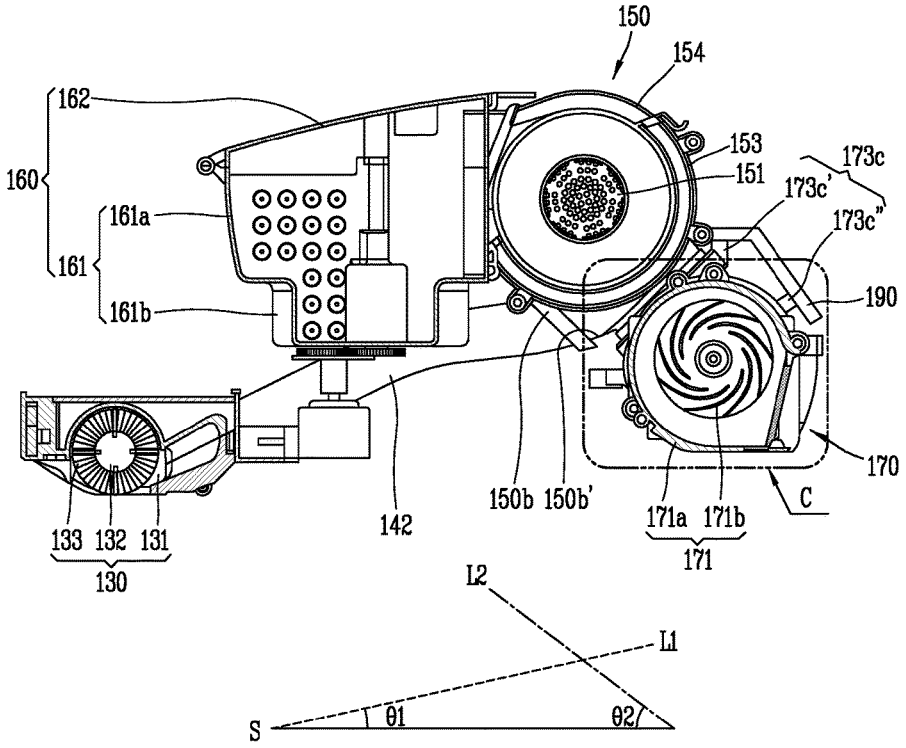
FIG. 12 is a sectional view taken along line 'A-A' in FIG. 11.

Referring to FIG. 12, the suction unit 130 includes a suction opening 131, a roller 132 and a brush 133. The suction opening 131 may be formed to extend in a lengthwise direction of the suction unit 130. The roller 132 is rotatably installed at the suction opening 131, and the brush 133 is mounted to an outer circumferential surface of the roller 132. The brush 133 is configured to sweep up dust on a floor to the suction opening 131. The brush 133 may be formed of various materials including a fibrous material, an elastic material, etc.

The first guiding member 141 and the second guiding member 142 may be provided between the suction unit 130 and the cyclone unit 150, thereby connecting the suction unit 130 and the cyclone unit 150 to each other. The first guiding member 141 and the second guiding member 142 are spaced from each other. One ends of the first and second guiding members 141 and 142 coupled to the suction unit 130 may be fixed to the cleaner body 101.

Air sucked through the suction unit 130 is introduced into the cyclone unit 150 in a diverged manner, through the first and second guiding members 141 and 142. Such a configuration is advantageous in that air sucking efficiency is enhanced, than in a case where a single guiding member is provided.

The first and second guiding members 141 and 142 may be disposed to be upward inclined toward the cyclone unit 150, so as to extend from the suction unit 130 toward the cyclone unit 150 (specifically, a first suction opening 150*a* and a second suction opening 150*b*), the cyclone unit 150 arranged at a rear upper side of the suction unit 130.

The cyclone unit 150 may be provided with a cylindrical inner circumferential surface, and may be long-formed along a prescribed direction (X1). The cyclone unit 150 may have an approximate cylindrical shape. The prescribed direction (X1) may be a direction perpendicular to a moving direction of the robot cleaner 100.

The cyclone unit 150 is configured to filter dust from air sucked thereto through the suction unit 130, using a centrifugal force. Air sucked into the cyclone unit 150 is rotated along an inner circumferential surface of the cyclone unit 150. During such a process, dust is collected to a dust box 160 communicated with a dust discharge opening 150*e*, and dust-filled air is introduced into a first cyclone 151 and a second cyclone 152.

The dust discharge opening 150*e* is formed at a front side of the cyclone unit 150. The dust discharge opening 150*e* may be formed between the first suction opening 150*a* and the second suction opening 150*b* (or between the first cyclone 151 and the second cyclone 152), i.e., at a central portion of the cyclone unit 150. Under such a structure, dust included in air introduced into two sides of the cyclone unit 150 through the first and second suction openings 150*a* and 150*b*, rotates along an inner circumferential surface of the cyclone unit 150, toward a central part from an end part of the cyclone unit 150. The dust is collected to the dust box 160 through the dust discharge opening 150*e*.

The dust box 160 is connected to the cyclone unit 150, and is configured to collect dust filtered by the cyclone unit 150. In this embodiment, the dust box 160 is disposed between the suction unit 130 and the cyclone unit 150.

The dust box 160 is detachably mounted to the cyclone unit 150 so as to be separable from the cleaner body 101, described hereinafter. When a cover 102 openably-coupled to the cleaner body 101 is open, the dust box 160 may be in a separable state by being exposed to the outside. The dust box 160 may be configured to be exposed to the outside, thereby forming appearance of the robot cleaner 100 together with the cleaner body 101. In this case, a user may check the amount of dust accumulated in the dust box 160 without opening the cover 102 through the light transmissive material of the dust box 102.

The dust box 160 may include a dust box body 161 and a dust box cover 162. The dust box body 161 forms a space for collecting dust filtered by the cyclone unit 150, and the dust box cover 162 is coupled to the dust box body 161 so as to open and close an opening of the dust box body 161. For instance, the dust box cover 162 may be configured to open and close the opening of the dust box body 161 by being hinge-coupled to the dust box body 161.

The dust discharge opening 150*e* may be formed to be communicated with the dust box body 161. However, the present disclosure is not limited to this. The dust discharge opening 150*e* may be formed to be communicated with the dust box cover 162 according to a modified design.

As aforementioned, the dust box 160 connected to the cyclone unit 150 may be formed to have a predetermined depth since the cyclone unit 150 is arranged at an upper side of the suction unit 130. For efficient spatial arrangement, at least part of the dust box 160 may be accommodated in a space between the first guiding member 141 and the second guiding member 142. In this embodiment, the dust box body 161 includes a first portion or chamber 161*a* and a second portion or chamber 161*b* having different sectional areas or different volume.

Figure 11:
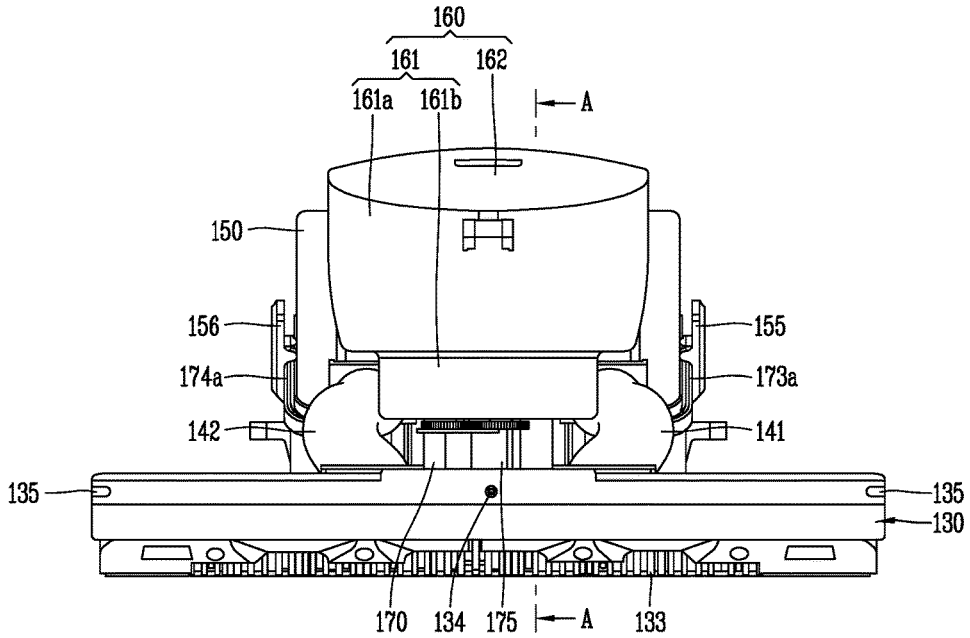
FIG. 11 is a frontal view of the robot cleaner of FIG. 10.

The first portion 161*a* may be communicated with the dust discharge opening 150*e*, and at least part of the first portion 161*a* may be disposed on the first and second guiding members 141 and 142. As shown in FIG. 11, in this embodiment, two sides of the first portion 161*a* are disposed on the first and second guiding members 141 and 142.

The second portion 161*b* is formed to extend from a lower side of the first portion 161*a*, and to have a smaller sectional area than the first portion 161*a*. Accordingly, at least part of the second portion 161*b* is accommodated in a space between the first and second guiding members 141 and 142. The first and second guiding members 141 and 142 may be formed such that at least part thereof is bent to enclose the second portion 161*b* at two sides.

Dust collected into the dust box 160 is firstly accumulated in the second portion 161*b*. In a modified embodiment, an inclined portion or wall inclined toward the second portion 161*b* so that dust can move to the second portion 161*b*, may be provided between the first portion 161*a* and the second portion 161*b*.

The dust box cover 162 may be arranged to be inclined so that at least part thereof can face the dust discharge opening 150*e*. Under such a structure, dust introduced into the dust box 160 through the dust discharge opening 150*e* can directly collide with or deflected by the dust box cover 162 without scattering, thereby being collected in the dust box body 161 (mainly, the second portion 161*b*).

The fan unit 170 is connected to the cyclone unit 150. The fan unit 170 includes a motor part or component 175 configured to generate a driving force, and a first fan part or component 171 and a second fan part or component 172 connected to two sides of the motor part 175 and configured to generate a suction force. The fan unit 170 may be fixed to the cleaner body 101, and may be provided at a rear lower side of the cyclone unit 150. The cyclone unit 150 may be coupled onto the fan unit 170 (specifically, a first communication member 173 and a second communication member 174), thereby being spaced from an inner bottom surface of the cleaner body 101.

As shown in FIG. 12, an arbitrary line (L1), which connects two ends of the first guiding member 141 or the second guiding member 142 to each other, has an inclination angle (θ1), from an inner bottom surface (S) of the cleaner body 101. An arbitrary line (L2), which connects the cyclone unit 150 and the fan unit 170 to each other, has an inclination angle (θ2), from the inner bottom surface (S) of the cleaner body 101. As such inclination angles (θ1 and θ2) are controlled, a volume of the dust box 160 may be variously changed.

Figure 13:
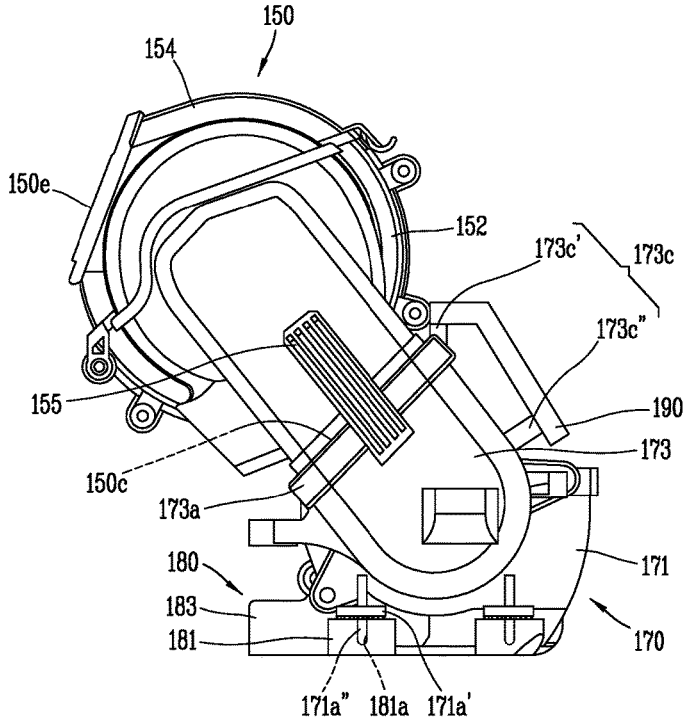
FIG. 13 is a side sectional view of a cyclone unit and a fan unit separated from the robot cleaner of FIG. 10.
Figure 14A:
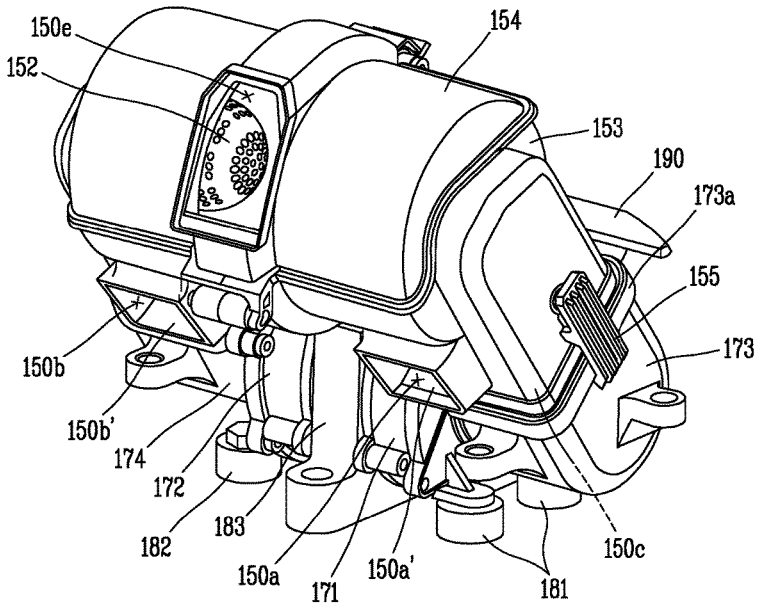
FIG. 14A is a perspective view of the cyclone unit and the fan unit of FIG. 13.
Figure 14B:
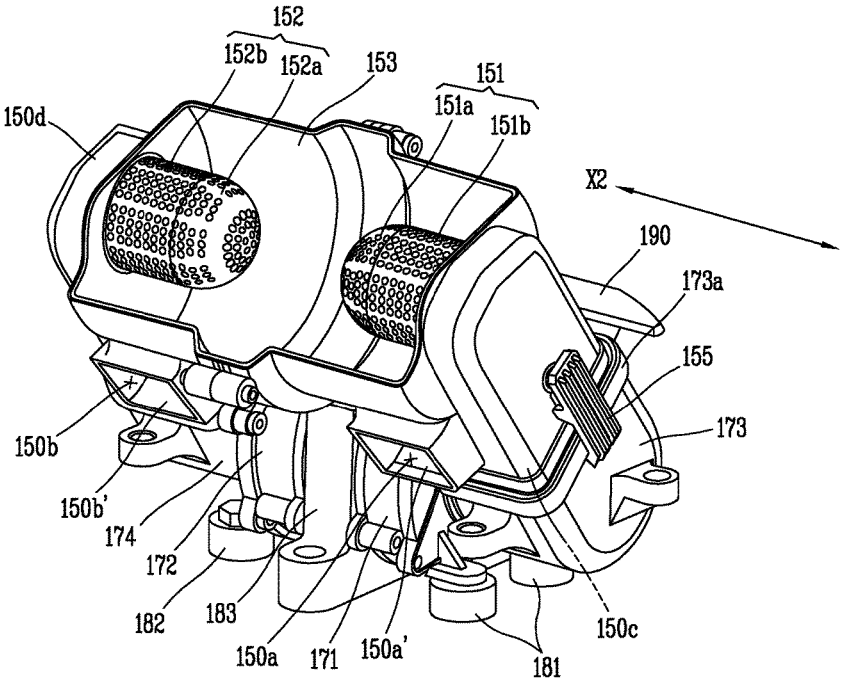
FIG. 14B illustrates a removed state of a second case of the cyclone unit shown in FIG. 14A.

Referring to FIGS. 13 to 14B together with the previous figures, the cyclone unit 150 is provided with the first suction opening 150*a* communicated with the first guiding member 141, and the second suction opening 150*b* communicated with the second guiding member 142. The first suction opening 150*a* and the second suction opening 150*b* may be formed at two sides of the cyclone unit 150 such that air introduced into the cyclone unit 150 through the first suction opening 150*a* and the second suction opening 150*b* rotates along an inner circumferential surface of the cyclone unit 150 toward a central location from an end location of the cyclone unit 150.

The cyclone unit 150 may further include a first suction guide 150*a*' and a second suction guide 150*b*' configured to guide air sucked to the cyclone unit 150 through the first suction opening 150*a* and the second suction opening 150*b* to an inner circumferential surface of the cyclone unit 150, respectively. The first suction guide 150*a*' is formed at the first suction opening 150*a* toward an inner circumferential surface of the cyclone unit 150, and the second suction guide 150*b*' is formed at the second suction opening 150*b* toward an inner circumferential surface of the cyclone unit 150.

The cyclone unit 150 is provided therein with the first cyclone 151 and the second cyclone 152 such that dust-filled air is introduced into the first cyclone 151 and the second cyclone 152. The first cyclone 151 has a structure that an air passing hole 151*b* is formed at a protruding member or filter 151*a* having a hollow inner space, and the second cyclone 152 has a structure that an air passing hole 152*b* is formed at a protruding member or filter 152*a* having a hollow inner space. Dust having a size greater than a prescribed diameter of the hole cannot pass through the air passing holes 151*b* and 152*b*, whereas dust having a size smaller than a prescribed diameter of the hole can pass through the air passing holes 151*b* and 152*b* to thus be introduced into the inner spaces of the protruding members 151*a* and 152*a*.

The first cyclone 151 may be arranged close to the first suction opening 150*a*, and the second cyclone 152 may be arranged close to the second suction opening 150*b*. Under such a structure, dust filled air sucked into the cyclone unit 150 through the first suction opening 150*a* is mainly introduced into the first cyclone 151, and dust filled air sucked into the cyclone unit 150 through the second suction opening 150*b* is mainly introduced into the second cyclone 152. Dust can be efficiently filtered from the sucked air, and the dust-filtered air can be more efficiently discharged from the cyclone unit 150.

The first and second cyclones 151 and 152 may be provided at two ends of the cyclone unit 150 in a facing manner. The first and second cyclones 151 and 152 may be formed to protrude from the same axis (X2). The axis (X2) may be perpendicular to a moving direction (forward or backward direction) of the robot cleaner 100. The axis (X2) may be identical to the aforementioned prescribed direction (X1).

The first and second cyclones 151 and 152 may be arranged at central regions of two end portions of the cyclone unit 150 so as to have a preset separating distance from an inner circumferential surface of the cyclone unit 150. Under such a structure, dust can rotate along an inner circumferential surface of the cyclone unit 150, and dust-filtered air can be mainly introduced into the first and second cyclones 151 and 152.

Figure 15:
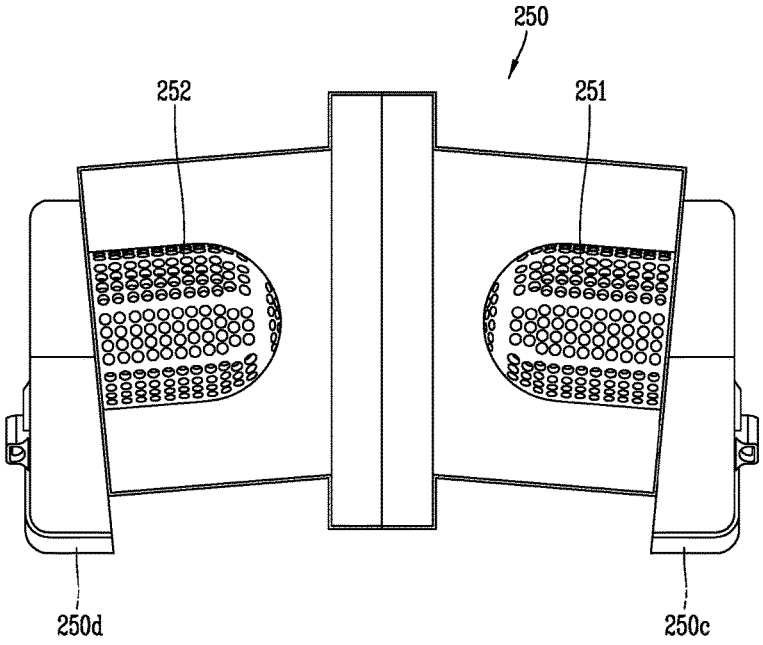
FIG. 15 illustrates a modification example of a cyclone unit.

Referring to FIG. 15 illustrating a modification example of the cyclone unit 150 of FIG. 14A, a cyclone unit 250 may be configured so that air which has passed through first and second suction openings can be introduced toward a central part of the cyclone unit 250. Under such a structure, air introduced into the cyclone unit 250 can easily rotate toward a central location of the cyclone unit 250 from an end location of the cyclone unit 250.

The cyclone unit 250 may be arranged so that a region for accommodating a first cyclone 251 and a region for accommodating a second cyclone 252 have a preset angle therebetween. The preset angle viewed from a front side may be 180° or less.

The first and second suction openings may be formed toward a central location of the cyclone unit 250 such that air is introduced into the central location of the cyclone unit 250. The first and second suction guides aforementioned with reference to the aforementioned embodiment may be formed to extend toward the central location of the cyclone unit 250.

Referring to FIGS. 13 and 14B back, the cyclone unit 150 may include a first case 153 and a second case 154. The first case 153 is provided with the first and second suction openings 150*a* and 150*b* and the first and second cyclones 151 and 152, and is configured to be coupled to the first and second guiding members 141 and 142. The second case 154 is provided with a dust discharge opening, and is openably coupled to the first case 153. For instance, the second case 154 may be hinge-coupled to the first case 153, and may be configured to open and close the first case 153 by being rotated.

As the second case 154 is separated from the first case 153 or rotated, inside of the cyclone unit 150 may be exposed. This is advantageous in that dust collected or stuck to in the air passing holes 151*b* and 152*b* of the first and second cyclones 151 and 152 can be easily removed.

The cyclone unit 150 may further include a first discharge opening 150*c* and a second discharge opening 150*d* communicated with inner spaces of the first and second cyclones 151 and 152 so that dust-filtered air can be discharged. As shown, the first discharge opening 150*c* and the second discharge opening 150*d* may be provided at two sides of the cyclone unit 150. The second discharge opening may be a mirror image of the first discharge opening 150*c* shown in FIG. 14A.

The fan unit 170 may be connected to each of the first discharge opening 150*c* and the second discharge opening 150*d*, such that dust-filtered air is discharged to the outside.

As shown in FIGS. 16A to 16E, the fan unit 170 includes a motor part or component 175, a first fan part or component 171, a second fan part or component 172, a first communication member 173 and a second communication member 174. Although the second fan part 172 is not shown, the second fan part 172 may be understood as a mirror image of the first fan part 171 shown in FIG. 16C.

The motor part 175 may be configured to generate a driving force, and may be provided at a central part of the fan unit 170. The motor part 175 includes a motor 175*c*, and a motor housing for accommodating the motor 175*c* therein. The motor 175*c* may be provided with rotation shafts at two sides thereof. The motor housing may include of a first motor housing 175*a* and a second motor housing 175*b* coupled to each other to accommodate the motor 175*c* therein.

The first fan part 171 and the second fan part 172 are connected to two sides of the motor part 175. The first fan part 171 includes a first fan 171*b* connected to a rotation shaft 175*c*' provided at one side of the motor 175*c*, and a first fan cover 171*a* configured to accommodate the first fan 171*b* therein. And the second fan part 172 includes a second fan 172*b* connected to a rotation shaft (not shown) provided at another side of the motor 175*c*, and a second fan cover 172*a* configured to accommodate the second fan 172*b* therein.

The first and second fans 171*b* and 172*b* are configured to generate a suction force by being rotated when the motor 175*c* is driven, and to discharge dust-filtered air to the outside. Each of the first and second fans 171*b* and 172*b* may be formed as a volute fan.

The first fan cover 171*a* is provided with a first air inlet 171*d* in a direction of a rotation shaft of the first fan part 171, and is provided with a first air outlet 171*e* in a radius direction of the first fan part 171. The second fan cover 172*a* is provided with a second air inlet in a direction of a rotation shaft of the second fan part 172, and is provided with a second air outlet in a radius direction of the second fan part 172. The second air inlet may be as a mirror image or structure of the first air inlet 171*d* shown in FIG. 16B, and the second air outlet may be understood as a mirror image or structure of the first air outlet 171*e* shown in FIG. 17.

Dust-filtered air is introduced into the first fan cover 171*a* through the first air inlet 171*d* by a suction force due to rotation of the first fan part 171. The air is moved to a side direction by rotation of the first fan part 171 implemented as a volute fan, and is discharged out through the first air outlet 171*e*. Such a mechanism may be equally applied to processes to suck and discharge air by rotation of the second fan part 172.

The first communication member 173 is configured to connect the first discharge opening 150*c* of the cyclone unit 150 with the first fan part 171, and thus to guide air introduced into the inner space of the first cyclone 151 into the first fan part 171. Likewise, the second communication member 174 is configured to connect the second discharge opening of the cyclone unit 150 with the second fan part 172, and thus to guide air introduced into the inner space of the second cyclone 152 into the second fan part 172.

Referring to FIGS. 13 to 14B, in a case where the cyclone unit 150 includes the first case 153 and the second case 154, the first case 153 may be provided with the first discharge opening 150*c* and the second discharge opening 150*d*, and may be coupled to each of the first and second communication members 173 and 174.

A first coupling member 155 for coupling with the first communication member 173, and a second coupling member 156 for coupling with the second communication member 174 may be provided at two sides of the first case 153. Each of the first and second coupling members 155 and 156 may include a hook and an elastic member. The hooks are rotatably coupled to two sides of the first case 153, and are locked by the first and second communication members 173 and 174.

The elastic members are configured to elastically press the hooks so that a locked state of the hooks to the first and second communication members 173 and 174 can be maintained. The first and second communication members 173 and 174 may be provided with locking protrusions 173*a* and 174*a* configured to lock the hooks so that the first case 153 can be prevented from being separated from the first and second communication members 173 and 174.

Coupling of the first case 153 with the first and second communication members 173 and 174 is not limited to the above coupling. The first case 153 may be coupled with the first and second communication members 173 and 174 in various manners without an additional coupling member, e.g., by using a locking structure or by bonding.

Fine dust filters 173*b* and 174*b*, configured to filter fine dust from dust-filtered air, may be mounted to the first and second communication members 173 and 174. The fine dust filters 173*b* and 174*b* may be HEPA filters. For replacement, the fine dust filters 173*b* and 174*b* may be configured to be exposed to the outside when the cyclone unit 150 is separated from the first and second communication members 173 and 174.

When the motor 175*c* of the fan unit 170 and the first and second fans 171*b*, 172*b* are driven, vibrations occur from the robot cleaner. If a suction force is increased for enhancement of a cleaning function, the motor 175*c* and the first and second fans 171*b*, 172*b* are rotated more rapidly. This may cause undesirable vibrations.

A supporting unit or support 180 configured to support the fan unit 170 may be disposed between an inner bottom surface of the cleaner body 101 and the fan unit 170. The supporting unit 180 is formed of an elastic material (e.g., rubber, urethane, silicone, etc.) so as to absorb vibrations generated from the fan unit 170. The supporting unit 180 is configured to elastically support the motor part 175, the first fan part 171 and the second fan part 172 which are the main components where vibrations occur.

The supporting unit 180 includes a motor supporting member or base 183 configured to elastically support the motor part 175, and first and second fan supporting members or base 181, 182 configured to elastically support the first and second fan parts 171, 172.

Figure 16A:
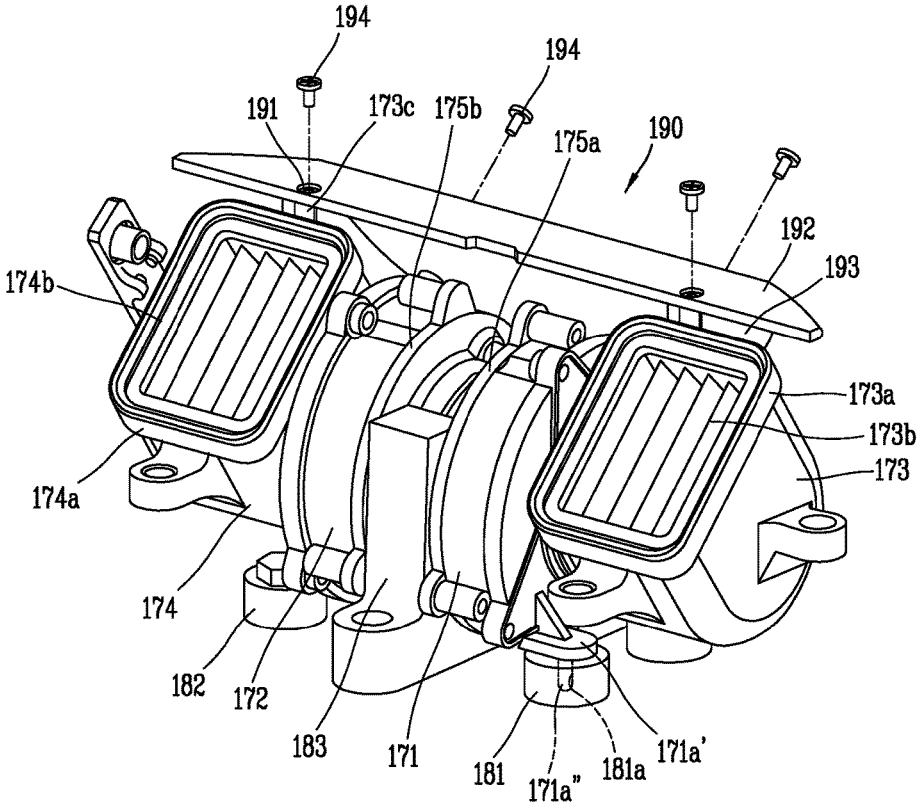
FIG. 16A is a perspective view of the fan unit shown in FIG. 13.

The motor supporting member 183 is installed on an inner bottom surface of the cleaner body 101, and is formed to enclose at least part of the motor part 175. Referring to FIGS. 16D and 16E, the motor supporting member 183 is formed to enclose an outer circumference of the motor housings 175*a*, 175*b*.

Referring to FIG. 16E, the motor supporting member 183 may include a base part or component 183*a* installed on the inner bottom surface of the cleaner body 101, and an extending part or component 183*b* upward extending from the base part 183*a* so as to enclose at least part of the motor part 175. The base part 183*a* and the extending part 183*b* may be integrally formed with each other by injection molding.

Coupling holes 183*c* are formed at the motor supporting member 183. Coupling members 184 are coupled to the inner bottom surface of the cleaner body 101 through the coupling holes 183*c* thereby fixing the motor supporting member 183 to the cleaner body 101. The coupling holes 183*c* are formed at two sides of the motor supporting member 183.

A plurality of ribs protrude from an outer circumference of the first motor housing 175*a*, and a plurality of ribs 175*b*' protrude from an outer circumference of the second motor housing 175*b*. The ribs 175*b*' are provided therein a coupling structure. For instance, the ribs of the first motor housing 175*a* are provided with protrusions, and the ribs 175*b*' of the second motor housing 175*b* are provided with accommodation grooves 175*b*" for accommodating the protrusions therein. As the protrusions are fitted into the accommodation grooves 175*b*", the first motor housing 175*a* and the second motor housing 175*b* may be coupled to each other.

An inner side of the extending part 183*b* may be formed to correspond to an outer circumference of the motor part 175, so as to enclose at least part of the motor part 175. The extending part 183*b* may be formed to cover at least one of the aforementioned plurality of ribs 175*b*'. In this case, an accommodation groove 183*b*' is preferably formed in the extending part 183*b*, in correspondence to the at least one rib. With such a configuration, as the rib 175*b*' is accommodated in the accommodation groove 183*b*', the motor part 175 may be fixed to the motor supporting member 183 more stably.

A hollow part 183*d* may be formed between the base part 183*a* and the extending part 183*b*, thereby reducing vibrations from being transmitted to the base part 183*a* from the extending part 183*b*. In the drawings, the hollow part 183*d* is formed at the motor supporting member 183 in plurality.

The first and second fan supporting members 181, 182 are configured to elastically support the first and second fan covers 171*a*, 172*a*, respectively. In the drawings, protruding parts 171*a*', 172*a*' protrude from the first and second fan covers 171*a*, 172*a*, so as to face the inner bottom surface of the cleaner body 101. And the first and second fan supporting members 181, 182 are disposed between the inner bottom surface of the cleaner body 101 and the protruding parts 171*a*', 172*a*'.

The first and second fan supporting members 181, 182 may be fixed to the protruding parts 171*a*', 172*a*'. For instance, referring to FIGS. 13 and 16A, a protrusion 171*a*" may be formed to protrude from the protruding part 171*a*', toward the inner bottom surface of the cleaner body 101. An insertion groove 181*a* configured to insert the protrusion 171 *a*" may be formed at the first fan supporting member 181. The first and second fan supporting members 181, 182 may be coupled to the protruding parts 171*a*', 172*a*', respectively, by another coupling structure, e.g., a coupling structure using screws, a bonding coupling structure, etc.

The first and second fan supporting members 181, 182 may be fixed to the inner bottom surface of the cleaner body 101, or may be supported on the inner bottom surface of the cleaner body 101 in a non-fixed state. In the case where the first and second fan supporting members 181, 182 are fixed to the inner bottom surface of the cleaner body 101, a coupling structure using screws may be used.

The first fan part 171 is connected to the first communication member 173, and the second fan part 172 is connected to the second communication member 174. Accordingly, vibrations generated from the first and second fan parts 171, 172 may be transmitted to the first and second communication members 173, 174 and noise may occur as the components come in contact with each other.

For reduction of such noise, a first connection member 185, formed of an elastic material so as to absorb vibrations generated from the first fan part 171, may be disposed between the first fan part 171 and the first communication member 173. Likewise, a second connection member (not shown), formed of an elastic material so as to absorb vibrations generated from the second fan part 172, may be disposed between the second fan part 172 and the second communication member 174.

Figure 16B:
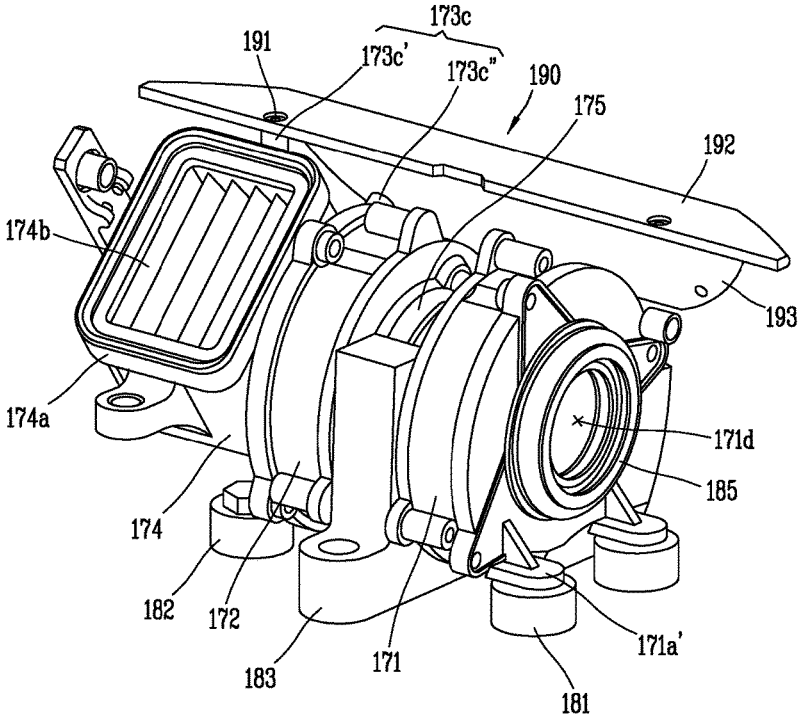
FIG. 16B illustrates a removed state of a first communication member from the fan unit shown in FIG. 16A.
Figure 16C:
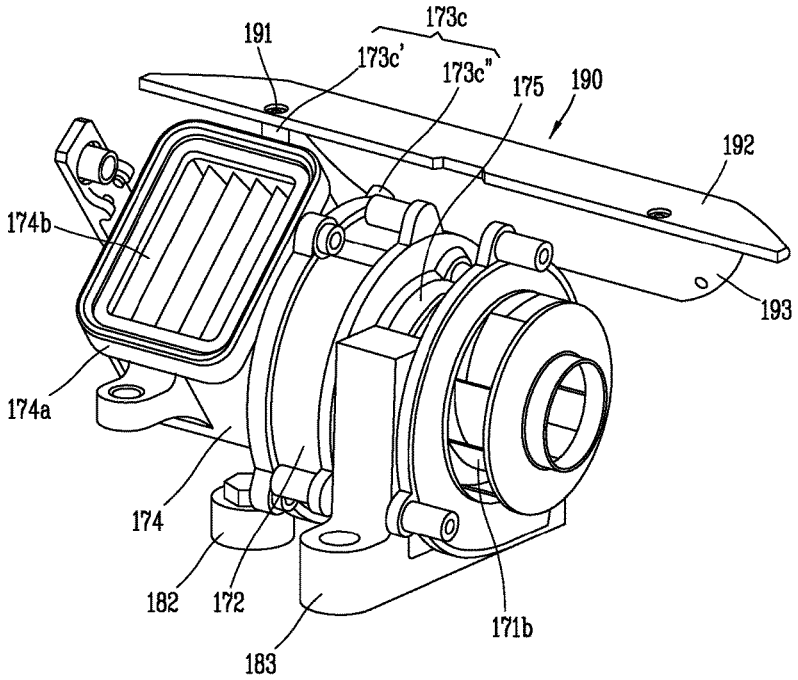
FIG. 16C illustrates a removed state of a first fan cover from the fan unit shown in FIG. 16B.
Figure 16D:
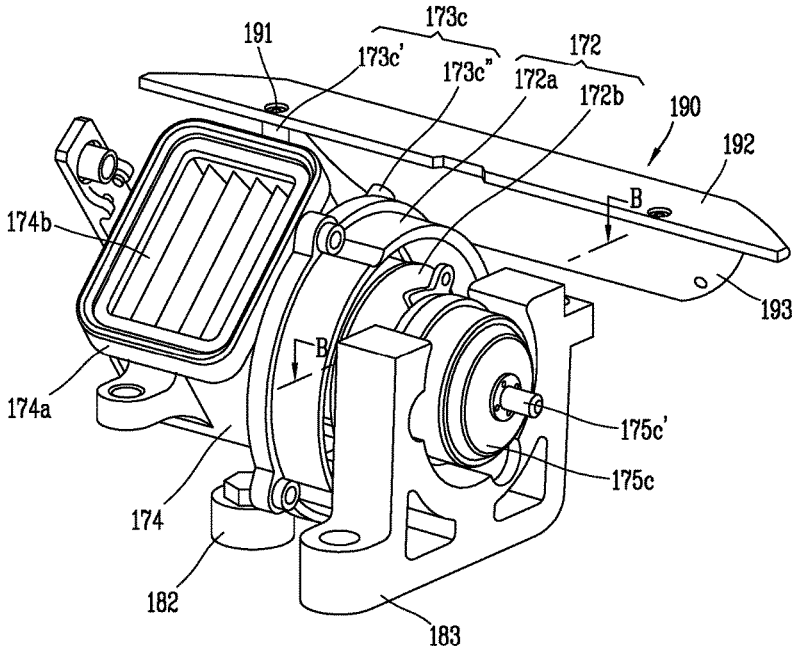
FIG. 16D illustrates a removed state of a first fan, a first motor housing and a second motor housing, from the fan unit shown in FIG. 16C.
Figure 16E:
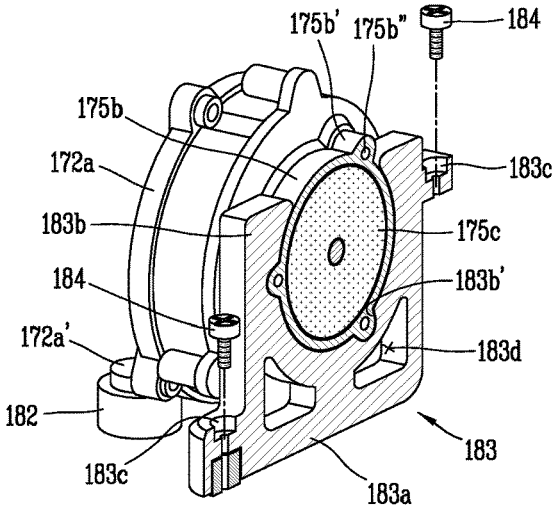
FIG. 16E is a cut-out view taken along line 'B-B' in the fan unit shown in FIG. 16D.

Referring to FIG. 16B, the first connection member 185 may be formed to have a ring shape so as to enclose the first air inlet 171*d* of the first fan cover 171*a*. The first connection member 185 is pressurized when the first fan part 171 and the first communication member 173 are coupled to each other, thereby being adhered to the first fan part 171 and the first communication member 173. The second connection member may be also formed to have a ring shape so as to enclose the second air inlet, in correspondence to the first connection member 185. The second connection member is formed to seal a gap occurring when the second communication member 174 and the second fan part 172 are coupled to each other.

The fan unit 170 may be a main component of the robot cleaner 100 where noise occurs. Moreover, since the robot cleaner 100 of the present disclosure is provided with the plurality of fan parts 171, 172 corresponding to the plurality of cyclones 151, 152, noise occurs absolutely. Hereinafter, a structure for reducing noise generated from the fan unit 170 will be explained.

Referring to FIGS. 16A to 16E with FIG. 13, a noise reducing member or component 190 is provided above the fan unit 170 so as to reduce noise. The noise reducing member 190 extends toward two sides of the motor part 175, thereby covering the first and second fan parts 171, 172. If necessary, the noise reducing member 190 may more extend to cover the first and second communication members 173, 174.

For smooth exhaustion, the noise reducing member 190 may be formed not to cover the first air outlet 171*e* of the first fan cover 171*a* and the second air outlet of the second fan cover 172*a*. The noise reducing member 190 extends to a lower side of the fan unit 170 from an upper side of the fan unit 170. In this case, the noise reducing member 190 may extend up to an upper side of the first and second air outlets, or may be provided with exhaustion holes at parts corresponding to the first and second air outlets.

As the noise reducing member 190 is disposed to cover an upper side of the fan unit 170, noise generated from the motor 175*c* and the first and second fans 171*b*, 172*b* may be prevented from being transmitted to the upper side of the fan unit 170. As noise is concentrated into the inner bottom surface by the noise reducing member 190, a user may recognize noise of a low level.

The noise reducing member 190 may reduce noise by irregularly reflecting or absorbing noise generated from the fan unit 170. For diffused reflection of noise, an inner side surface of the noise reducing member 190, which faces the fan unit 170, may have a concavo-convex structure. For absorption of noise, a noise absorbent (not shown) configured to absorb at least part of noise may be attached to the inner side surface of the noise reducing member 190, which faces the fan unit 170. The noise absorbent may be formed of a porous material such as a sponge.

Preferably, the noise reducing member 190 is disposed to cover most regions of the upper side of the fan unit 170. However, in some cases, the noise reducing member 190 may be disposed to cover a partial region of the upper side of the fan unit 170. Referring to FIG. 12, the cyclone unit 150 is connected to a front upper side of the fan unit 170. In this case, the noise reducing member 190 may be installed at the fan unit 170 so as to cover a rear upper side of the fan unit 170.

Since the noise reducing member 190 is configured to reduce noise generated from the motor 175*c* and the first and second fans 171*b*, 172*b*, the noise reducing member 190 may be installed at the fan unit 170. In the drawings, the noise reducing member 190 is mounted to the first and second communication members 173, 174. However, the installation position of the noise reducing member 190 is not limited to the fan unit 170. That is, the noise reducing member 190 may be mounted to any region adjacent to the fan unit 170, e.g., the cyclone unit 150, the inside of the cleaner body 101, etc. For instance, the noise reducing member 190 may be installed at the first case 153 of the cyclone unit 150, and may extend from the first case 153 toward the fan unit 170 so as to cover an upper side of the fan unit 170.

A coupling boss 173*c* for coupling with the noise reducing member 190 protrudes from each of the first and second communication members 173, 174. Referring to FIGS. 12 and 16A, a first coupling boss 173*c*' and a second coupling boss 173*c*", which protrude toward the noise reducing member 190, are provided at the first communication member 173. The noise reducing member 190 is spaced apart from the fan unit 170, in a supported state by the first and second coupling bosses 173*c*', 173*c*". And coupling members 194 are coupled to the first and second coupling bosses 173*c*', 173*c*" via coupling holes 191 of the noise reducing member 190, thereby fixing the noise reducing member 190 to the first communication member 173.

The noise reducing member 190 extends along a direction, so as to cover the motor part 175 and the first and second fan parts 171, 172 disposed at two sides of the motor part 175. And the noise reducing member 190 may extend toward a lower side of the fan unit 170, from an upper side of the fan unit 170. For instance, as shown, the noise reducing member 190 includes a base part 192 and an extending part 193. The base part 192 and the extending part 193 may have a flat shape, and may be connected to each other in a bent manner.

More specifically, the base part 192 is disposed to cover an upper side of the fan unit 170, and is mounted to the first coupling bosses 173*c*' of the first and second communication members 173, 174 by the coupling members 194. The extending part 193 downward extends from the base part 192 in a bent manner, thereby covering a rear upper side of the fan unit 170. The extending part 193 is mounted to the second coupling bosses 173*c*" of the first and second communication members 173, 174 by the coupling members 194. For smooth exhaustion, the extending part 193 is preferably disposed not to cover the first air outlet 171*e* of the first fan cover 171*a*, and the second air outlet of the second fan cover 172*a*.

A noise absorbent, configured to absorb at least part of noise generated from the fan unit 170, may be attached to the inside of at least one of the base part 192 and the extending part 193. The noise reducing member 190 may be formed to have a rounded shape corresponding to the appearance of the fan unit 170, so as to enclose at least part of the fan unit 170. For instance, the noise reducing member 190 may be formed in a semi-circular shape, and may be disposed to cover a rear upper side of the fan unit 170.

Figure 17:
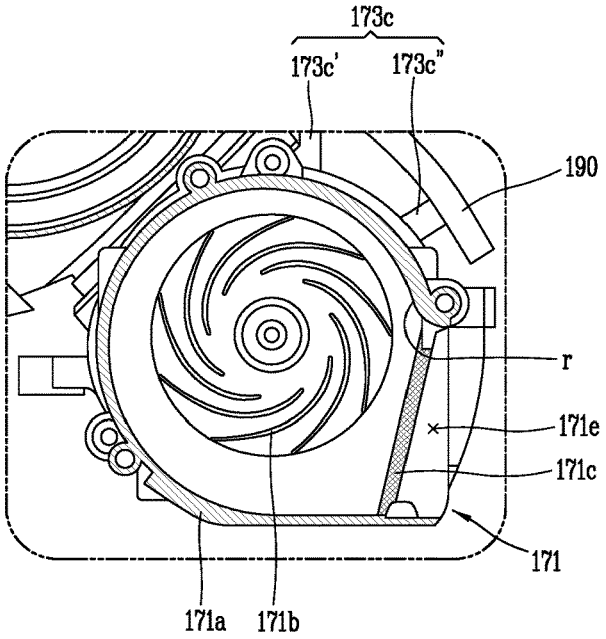
FIG. 17 is an enlarged view of part 'C' in FIG. 12.

Referring to FIG. 17, a gap may be maintained between an inner circumferential surface of the first fan cover 171*a*, and an inner portion of the first fan 171*b* disposed close to the inner circumferential surface of the first fan cover 171*a*.

Likewise, a gap may be maintained between an inner circumferential surface of the second fan cover 172*a*, and an inner portion of the second fan 172*b* disposed close to the inner circumferential surface of the second fan cover 172*a*.

The first fan cover 171*a* may be provided with a first exhaustion guide (r) and the second fan cover 172*a* may be provided with a second exhaustion guide, each exhaustion guide for guiding smooth exhaustion of dust-filtered air. The first exhaustion guide (r) may extend from an inner circumferential surface of the first fan cover 171*a* toward the first air outlet 171*e*, in a rounded manner. The second exhaustion guide may be understood as a mirror image or structure/arrangement of the first exhaustion guide (r) shown in FIG. 17.

A first exhaustion hole corresponding to the first air outlet 171*e*, and a second exhaustion hole corresponding to the second air outlet may be formed at the cleaner body 101. For exhaustion of cleaner air, a fine dust filter 171*c* may be mounted to at least one of the first fan cover 171*a* and the cleaner body 101. As the fine dust filter 171*c*, a HEPA filter may be used. The fine dust filter 171*c* is mounted to cover at least one of the first air outlet 171*e* and the first exhaustion hole, and is configured to filter fine dust from dust-separated air. The fine dust filter 171*c* may be mounted to at least one of the second fan cover 172*a* and the cleaner body 101.

Firstly, since the mop module of the present disclosure is detachably mounted to the cleaner body instead of the suction unit, a space for the mop module can be sufficiently obtained. This can provide a robot cleaner capable of effectively executing a floor wiping function. Since the hooks are elastically transformed by a user's operation to press the pressing members, the mop module coupled to the cleaner body can be easily separated. Since the dust box is disposed between the suction unit and the cyclone unit, a compact design can be implemented. Further, effective air flow (having a flow change more than 90°) can be generated for separation of dust.

In the robot cleaner of the present disclosure, since a plurality of cyclones are provided in a single cyclone unit, dust can be efficiently separated from sucked air. For enhanced separation of dust, a plurality of guiding members are provided in correspondence to the plurality of cyclones. Air sucked through the suction unit is introduced into the cyclone unit in a diverged manner, and the fan unit discharges air having passed through the plurality of cyclones to the outside. With such a structure, dust is separated from sucked air in a more efficient manner, and the dust-separated air is discharged to the outside. This can enhance cleaning performance of the robot cleaner.

Further, in the present disclosure, there are provided the suction guide for guiding sucked air to an inner circumferential surface of the cyclone unit, and the exhaustion guide extending from an inner circumferential surface of the fan cover toward the air outlet in a rounded manner. With such a structure, the robot cleaner can reduce noise occurring when air is sucked and discharged to the outside.

Further, since dust having a large particle size is firstly filtered by the cyclone unit, and then fine dust is filtered by the fine dust filter provided on at least one of the suction side and the exhaustion side of the fan unit. This can allow cleaner air to be discharged to the outside of the robot cleaner.

In the present disclosure, the cyclone unit having the plurality of cyclones is disposed on the rear upper side of the suction unit, and the plurality of connection members are formed with an inclination angle so as to connect the suction unit and the cyclone unit to each other. And the fan unit is disposed on the rear lower side of the cyclone unit. With such a new structure and arrangement, the robot cleaner can have efficient spatial arrangement and enhanced cleaning performance.

Further, in a case where at least part of the dust box is accommodated in a space between the plurality of connection members, the dust box can have a larger capacity within the restricted space.

Noise of the robot cleaner is mainly generated from driving of the motor and the fan. Considering this, the noise reducing member is disposed above the fan unit to prevent noise generated from the fan unit from being transmitted to the upper side. This can allow the robot cleaner to have low noise.

Further, in the present disclosure, the motor supporting member configured to elastically support the motor part, and the first and second fan supporting members configured to elastically support the first and second fan parts are provided. This can reduce vibrations and noise generated from the fan unit.

A robot cleaner according to the present disclosure may perform a floor wiping function, as well as its another function to remove dust on a floor. A robot cleaner according to the present disclosure allows a mop installation structure, to easily install a mop.

A mop module for a robot cleaner may include a module body detachably coupled to a cleaner body; and a mop mounted to the module body, and configured to wipe a floor as the cleaner body moves, wherein the module body includes: a hook protruding from the module body, and detachably mounted to the cleaner body by being elastically transformed; and a pressing member installed at the module body so as to be moveable in two opposite directions, and configured to elastically transform the hook in a pressing manner when moved in one direction by a pressing operation.

In an embodiment of the present disclosure, the hook may include: a hook body protruding from the module body; and an elastic transformation portion connected to the hook body, and elastically transformed by an external force. When the pressing member is moved to said one direction by being pressed, the elastic transformation portion may be pressed by the pressing member to thus be elastically transformed toward the hook body.

The pressing member may include: an extension portion formed to extend in said one direction; a pressing portion protruding from the extension portion, and configured to press the elastic transformation portion when pressed; and a manipulation portion provided at one end of the extension portion, and exposed to the outside for a pressing operation.

The module body may further include: a guide groove which extends along said one direction so as to guide movement of the extension portion; and an opening which is open at the guide groove toward one surface of the module body such that the pressing portion is exposed to said one surface of the module body where the hook is formed.

The pressing portion may be formed to move in another direction by restoration of the elastic transformation portion, and to be locked to one inner wall of the module body which forms the opening, if the pressed state by the pressing operation is released.

The pressing portion may be configured to contact the elastic transformation portion, in a locked state to one inner wall of the module body which forms the opening. The hook may be one of first and second hooks disposed at the module body in a spaced manner. The pressing portion may be provided to correspond to the first and second hooks, so as to elastically transform the first and second hooks in a pressing manner when the pressing member is pressed.

The elastic transformation portion may include first and second elastic transformation portions disposed at two sides of the hook body. The pressing member may be one of a first pressing member configured to elastically transform the first elastic transformation portion in a pressing manner, and a second pressing member configured to elastically transform the second elastic transformation portion in a pressing manner.

The first and second pressing members may be configured to press the first and second elastic transformation portions toward the hook body, by being moved in opposite directions when pressed.

An opening communicated with an empty space inside the module body may be formed at an upper side of the module body, such that water is injected into the module body through the opening. A cap may be configured to open and close the opening. A discharge hole, through which water contained in the module body is discharged out, may be formed on a bottom surface of the module body where the mop is mounted.

A heating unit, configured to heat water contained in the module body such that steam is discharged out through the discharge hole, may be provided in the module body.

A robot cleaner may include a cleaner body formed to autonomously move over a predetermined region; and a mop module including a module body detachably coupled to the cleaner body, and a mop mounted to the module body and configured to wipe a floor as the cleaner body moves, wherein the module body includes: a hook protruding from the module body, and detachably mounted to the cleaner body by being elastically deflected; and a first and second sliders provided at the module body such that the first and second sliders are moveable in opposing directions, and configured to elastically deflect the hook when the first and second slider move in opposing directions, wherein the cleaner body is provided with a guiding member configured to guide air sucked through a suction unit to a suction opening of a cyclone unit, if the suction unit is installed instead of the mop module, and wherein the hook is detachably mounted to the guiding member.

The guiding member may include first and second guiding members spaced from each other, and connected to the cyclone unit. The hook may be one of first and second hooks detachably mounted to the first and second guiding members, respectively. A groove may extend from an upper surface of the module body in back and forth directions. A rib corresponding to the groove may protrude from the cleaner body, thereby guiding mounting of the module body.

This application relates to U.S. application Ser. No. 14/952,760 filed on Nov. 25, 2015, and Ser. No. 14/955,940 filed on Dec. 1, 2015, which are hereby incorporated by reference in their entirety. Further, one of ordinary skill in the art will recognize that features disclosed in these above-noted applications may be combined in any combination with features disclosed herein.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A mop module for a robot cleaner, comprising:
- a module body configured to be detachably coupled to a cleaner body; and
- a mop mounted to the module body,
- wherein the module body includes:
- a hook protruding from the module body, and detachably mounted to the cleaner body by being elastically deflected; and
- a pressing member provided at the module body so as to be moveable in opposing directions, and configured to elastically deflect the hook when pressed in a first direction.

2. The mop module for a robot cleaner of claim 1, wherein the hook includes:
- a hook body protruding from the module body; and
- an elastic extension connected to the hook body,
- wherein when the pressing member is moved to the first direction, the elastic extension is deflected toward the hook body.

3. The mop module for a robot cleaner of claim 2, wherein the pressing member includes:
- a rod extending in the first direction;
- a first tab protruding from the rod; and
- a second tab provided at one end of the rod and exposed to the outside.

4. The mop module for a robot cleaner of claim 3, wherein the module body further includes:
- a guide groove which extends along the first direction so as to guide movement of the rod; and
- an opening which is open at the guide groove toward a first surface of the module body such that the first tab is exposed to the first surface of the module body where the hook is formed.

5. The mop module for a robot cleaner of claim 4, wherein the first tab is formed to move in a second direction by restoration of the elastic extension, and to be locked to an inner wall of the module body which forms the opening when pressure on the second tab is released.

6. The mop module for a robot cleaner of claim 5, wherein the first tab is configured to contact the elastic extension in a locked state to the inner wall of the module body which forms the opening.

7. The mop module for a robot cleaner of claim 3, wherein the hook include at least one of first hook or second hook at the module body.

8. The mop module for a robot cleaner of claim 7, wherein the first tab is provided to correspond to at least one of the first hook or the second hook, so as to elastically deflect at least one of the first hook or the second hook when the second tab is pressed.

9. The mop module for a robot cleaner of claim 2, wherein the elastic extension includes first and second elastic extensions disposed at two sides of the hook body, and wherein the first tab is a first pressing member configured to elastically deflect the first elastic extension, and a second pressing member configured to elastically deflect the second elastic extension.

10. The mop module for a robot cleaner of claim 9, wherein the first and second pressing members are configured to press the first and second elastic extensions toward the hook body by moving in opposing directions when the second tab is pressed.

11. The mop module for a robot cleaner of claim 1, wherein an opening communicated with an empty space inside the module body is formed at an upper surface of the module body, such that water is provided into the module body through the opening, wherein a cap is configured to open and close the opening, and wherein a discharge hole, through which water contained in the module body is discharged out, is formed on a bottom surface of the module body where the mop is mounted.

12. The mop module for a robot cleaner of claim 11, wherein a heating unit, configured to heat water contained in the module body such that steam is discharged out through the discharge hole, is provided in the module body.

13. A robot cleaner, comprising:

a cleaner body configured to autonomously move over a predetermined region; and a mop module including a module body detachably coupled to the cleaner body, and a mop mounted to the module body, wherein the module body includes:

a hook protruding from the module body, and detachably mounted to the cleaner body by being elastically deflected; and first and second slides provided at the module body such that the first and second slides are moveable in opposing directions, and configured to elastically deflect the hook when the first and second slides are moved in the opposing directions, wherein the cleaner body is provided with at least one air flow guide tube configured to guide air sucked through a suction unit to a suction opening of a cyclone unit, and wherein the hook is detachably mounted to the at least one air flow guide tube.

14. The robot cleaner of claim 13, wherein the at least one air flow guide tube includes first and second air flow guide tubes spaced from each other and connected to the cyclone unit, and wherein the hook is one of first and second hooks detachably mounted to the first and second air flow guide tubes, respectively.

15. The robot cleaner of claim 13, wherein a groove extends from an upper surface of the module body in back and forth directions, and wherein a rib corresponding to the groove protrudes from the cleaner body, thereby guiding mounting of the module body.

* * * * *